US009564684B2

(12) United States Patent
Tseng et al.

(10) Patent No.: US 9,564,684 B2
(45) Date of Patent: Feb. 7, 2017

(54) ANTENNA STRUCTURE AND WIRELESS COMMUNICATION DEVICE USING THE SAME

(71) Applicant: Chiun Mai Communication Systems, Inc., New Taipei (TW)

(72) Inventors: Ting-Chih Tseng, New Taipei (TW); Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 212 days.

(21) Appl. No.: 14/014,666

(22) Filed: Aug. 30, 2013

(65) Prior Publication Data

US 2014/0191906 A1 Jul. 10, 2014

(30) Foreign Application Priority Data

Jan. 9, 2013 (TW) ..... 102100800 A

(51) Int. Cl.

| | |
|---|---|
| ***H01Q 5/307*** | (2015.01) |
| ***H01Q 9/42*** | (2006.01) |
| ***H01Q 5/10*** | (2015.01) |
| ***H01Q 5/371*** | (2015.01) |
| ***H01Q 5/378*** | (2015.01) |

(52) U.S. Cl.

CPC ..... *H01Q 5/307* (2015.01); *H01Q 5/10* (2015.01); *H01Q 5/371* (2015.01); *H01Q 5/378* (2015.01); *H01Q 9/42* (2013.01)

(58) Field of Classification Search

CPC ..... H01Q 5/00; H01Q 5/378; H01Q 5/392

See application file for complete search history.

(56) References Cited

U.S. PATENT DOCUMENTS

| | | | | |
|---|---|---|---|---|
| 4,864,320 | A * | 9/1989 | Munson et al. | 343/833 |
| 2008/0129630 | A1* | 6/2008 | Baliarda et al. | 343/793 |
| 2011/0032166 | A1* | 2/2011 | Zhang et al. | 343/767 |

FOREIGN PATENT DOCUMENTS

| | | |
|---|---|---|
| TW | I378602 | 5/2010 |

* cited by examiner

*Primary Examiner* — Michael C Wimer
*Assistant Examiner* — Noel Maldonado
(74) *Attorney, Agent, or Firm* — Zhigang Ma

(57) ABSTRACT

An antenna structure includes a feed portion, a ground portion, a first radiating body, a second radiating body and a third radiating body. The first radiating body is connected to the feed portion and configured to obtain a first resonance frequency band. The second radiating body is connected to the feed portion. The third radiating body includes a first connection section connected the ground end, a second connection section, and a third connection section perpendicularly connected between the first connection section and the second connection section. The first connection section and the second connection section are positioned at two opposite sides of the second radiating body so that the third radiating body and the second radiating body cooperatively obtain a second resonance frequency band.

2 Claims, 3 Drawing Sheets

ANTENNA STRUCTURE AND WIRELESS COMMUNICATION DEVICE USING THE SAME

BACKGROUND

1. Technical Field

The disclosure generally relates antenna structures and particularly to an antenna structure having a wider bandwidth and a wireless communication device using the antenna structure.

2. Description of Related Art

To communicate in multi-band communication systems, a bandwidth of an antenna of a wireless communication device such as a mobile phone should be wide enough to cover frequency bands of the multi-band communication systems. In addition, because of the miniaturization of the wireless communication device, space occupied by the antenna is compressed and limited. Therefore, it is necessary to design the antenna to have the wider bandwidth within the compressed and limited space.

Therefore, there is room for improvement within the art.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the disclosure.

DETAILED DESCRIPTION

Figure 1:
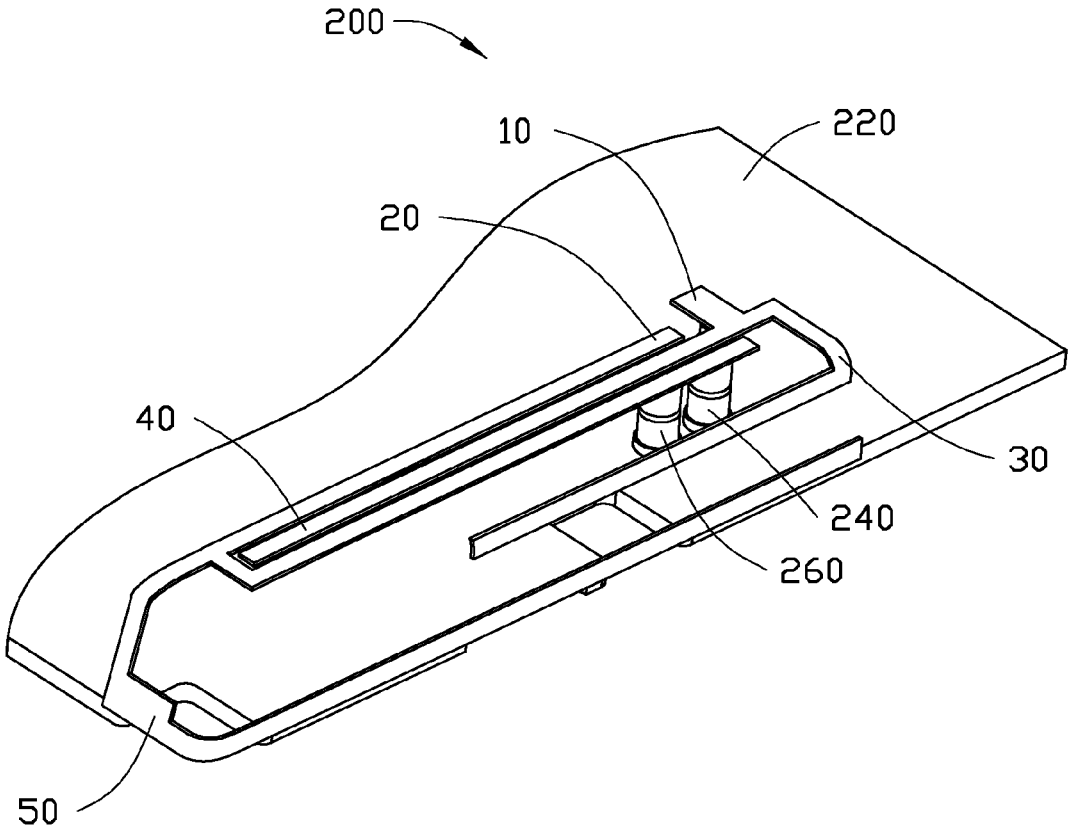
FIG. 1 is a schematic view of a wireless communication device having an antenna structure, according to an exemplary embodiment of the disclosure.

FIG. 1 is a schematic view of a wireless communication device 200 having an antenna structure 100, according to an exemplary embodiment of the disclosure. The wireless communication device 200 may be a mobile phone. In this exemplary embodiment, the antenna structure 100 is suspended above a main board 220 of the wireless communication device 200.

The main board 220 is a substantially rectangular board. A feed contact 240 and a ground contact 260 spaced from the feed contact 240 are positioned on the main board 220.

The antenna structure 100 includes a feed portion 10, a ground portion 20, a first radiating body 30, a second radiating body 40, and a third radiating body 50.

The feed portion 10 is electronically connected to the feed contact 240, and is configured to feed current for the antenna structure 100. The ground portion 20 is electronically connected to the ground contact 260, and is configured to provide ground for antenna structure 100 so that the current feed into the antenna structure 100 can form a current loop.

Figure 2:
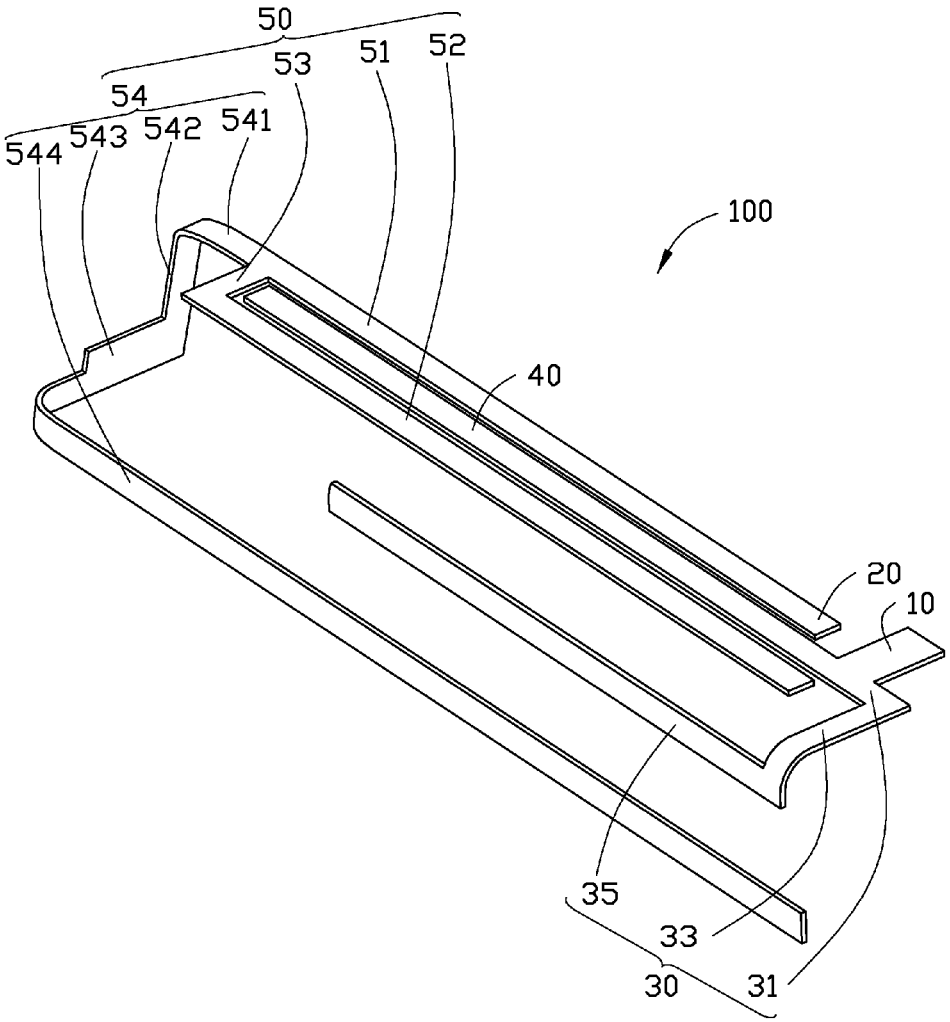
FIG. 2 is a schematic view of the antenna structure of FIG. 1, according to an exemplary embodiment of the disclosure.

FIG. 2 shows that the first radiating body 30 includes a first extending section 31, a second extending section 33, and a third extending section 35 connected in order. In this exemplary embodiment, the first extending section 31 and the second extending section 33 are coplanar. The first extending section 31 is perpendicularly connected to one end of the feed end 10. One end of the second extending section 33 is perpendicularly connected to the first extending section 31. Another end of the second extending section 33 is connected to the third extending section 35 by a first arc-shaped surface. The third extending section 35 is positioned at a plane substantially perpendicular to the first extending section 31. A length of the first radiating body 30 can be adjusted to make the antenna structure 100 obtain a first frequency band. In this exemplary embodiment, the first frequency band is about 1680 MHz-2060 MHz.

The second radiating body 40 is substantially strip-shaped. The second radiating body 40 is perpendicularly connected to one end of the feed end 10 and collinear with the first extending section 31. A length of the second radiating body 40 is longer than that of the third extending section 35.

The third radiating body 50 includes a first connection section 51, a second connection section 52, a third connection section 53 and a bent section 54.

The first connection section 51 and the second connection section 52 are substantially strip-shaped and parallel to each other. The third connection section 53 is perpendicularly connected between the first connection section 51 and the second connection section 52 and forms a substantially U-shaped structure. One end of the first connection section 51 opposite to the third connection section 53 is served as the ground end 20. In this exemplarily embodiment, lengths of the first connection section 51, the second connection section 52 and the second radiating body 50 are substantially equal to each other. The first connection section 51 and the second connection section 52 are positioned at two opposite sides of the second radiating body 40 and spaced from the second radiating body 40.

The bent section 54 is configured to increase a radiation efficiency of the antenna structure 100. The bent section 54 includes a first strip 541, a second strip 542, a third strip 543, and a fourth strip 544. The first strip 541 extends from one end of the first connection section 51 opposite to the ground portion 20. The second strip 542 is bent from one end of the first strip 541. The second strip 542 and the third strip 543 are coplanar. One end of the third strip 543 is perpendicularly connected to the second strip 542. Another end of the third strip 543 is perpendicularly connected to the fourth strip 544 by a second arc-shaped surface. The fourth strip 544 extends from the third strip 543 along a direction parallel to the third extending section 35. A length of the third radiating body 50 and a distance between the third radiating body 50 and the second radiating body 40 can be adjusted to make the antenna structure 100 obtains a second frequency band. In this exemplary embodiment, the second frequency band is about 810 MHz-1080 MHz.

Figure 3:
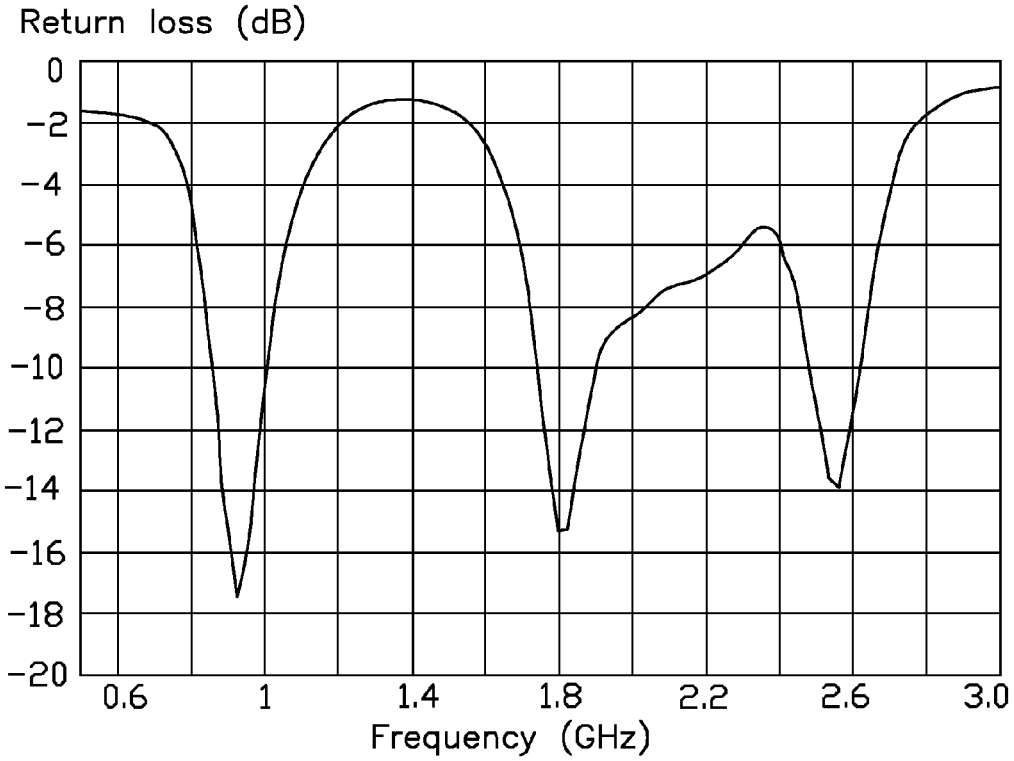
FIG. 3 is a diagram showing return loss measurements of the antenna structure of FIG. 2.

FIG. 3 shows that in use, the feed portion 10 feeds current from the feed contact 240 of the wireless communication device 200. The first radiating body 30 independently activates the first resonance frequency band about 1680 MHz-2060 MHz. The second radiating body 40 and the third radiating body 50 cooperatively generate the second resonance frequency band about 810 MHz-1080 MHz. Thus, the antenna structure 100 can transmit and receive signal of multiple frequency bands and have a widened bandwidth.

The second radiating body 40 and the third radiating body 50 can cooperatively activate a new resonance mode so that a bandwidth of the antenna structure is widened. In addition, the first radiating body 30, the second radiating body 40 and the third radiating body 50 are positioned at the multiple planes so that the entire volume of the antenna structure 100 is compressed.

It is believed that the exemplary embodiments and their advantages will be understood from the foregoing description, and it will be apparent that various changes may be made thereto without departing from the spirit and scope of the disclosure or sacrificing all of its material advantages, the examples hereinbefore described merely being preferred or exemplary embodiments of the disclosure.

What is claimed is:

1. An antenna structure, comprising:

a feed portion;

a ground portion;

a first radiating body connected to the feed portion, the first radiating body configured to obtain a first resonance frequency band;

a second radiating body connected to the feed portion; and a third radiating body, the third radiating body comprising a first connection section connected to the ground end, a second connection section, and a third connection section perpendicularly connected between the first connection section and the second connection section, the first connection section and the second connection section positioned at two opposite sides of the second radiating body so that the third radiating body and the second radiating body cooperatively obtain a second resonance frequency band;

wherein the first radiating body comprises a first extending section, a second extending section, and a third extending section connected in order, the first extending section is perpendicularly connected to the second extending section, and coplanar with the second extending section, the second extending section is connected to the third extending section by a first arc, the third extending section is positioned at a plane substantially perpendicular to the first extending section;

wherein the second radiating body is perpendicularly connected to one end of the feed end, and collinear with the first extending section; and wherein the third radiating body further comprises a bent section, the bent section comprises a first strip, a second strip, a third strip, and a fourth strip connected in order, the first strip extends from one end of the first connection section opposite to the ground portion, the second strip is bent from one end of the first strip, and coplanar with the third strip, one end of the third strip is perpendicularly connected to the second strip, another end of the third strip is perpendicularly connected to the fourth strip by a second arc, the fourth strip extends from the third strip along a direction parallel to the third extending section.

2. A wireless communication device, comprising:

a main board, the main board comprising a feed contact and a ground contact; and an antenna structure, the antenna structure comprising:

a feed portion electronically connected to the feed contact;

a ground portion electronically connected to the ground contact;

a first radiating body connected to the feed portion, the first radiating body configured to obtain a first resonance frequency band;

a second radiating body connected to the feed portion; and a third radiating body, the third radiating body comprising a first connection section connected to the ground end, a second connection section, and a third connection section perpendicularly connected between the first connection section and the second connection section, the first connection section and the second connection section positioned at two opposite sides of the second radiating body so that the third radiating body and the second radiating body cooperatively obtain a second resonance frequency band;

wherein the first radiating body comprises a first extending section, a second extending section, and a third extending section connected in order, the first extending section is perpendicularly connected to the second extending section, and coplanar with the second extending section, the second extending section is connected to the third extending section by a first arc, the third extending section is positioned at a plane substantially perpendicular to the first extending section;

wherein the second radiating body is perpendicularly connected to one end of the feed end, and collinear with the first extending section; and wherein the third radiating body further comprises a bent section, the bent section comprises a first strip, a second strip, a third strip, and a fourth strip connected in order, the first strip extends from one end of the first connection section opposite to the ground portion, the second strip is bent from one end of the first strip, and coplanar with the third strip, one end of the third strip is perpendicularly connected to the second strip, another end of the third strip is perpendicularly connected to the fourth strip by a second arc, the fourth strip extends from the third strip along a direction parallel to the third extending section.

* * * * *